US011096854B2

(12) United States Patent
Kazerooni et al.

(10) Patent No.: US 11,096,854 B2
(45) Date of Patent: Aug. 24, 2021

(54) HUMAN MACHINE INTERFACES FOR LOWER EXTREMITY ORTHOTICS

(71) Applicants: Ekso Bionics, Inc., Richmond, CA (US); The Regents of the University of California, Oakland, CA (US)

(72) Inventors: Homayoon Kazerooni, Oakland, CA (US); Katherine Strausser, Berkeley, CA (US); Adam Zoss, Berkeley, CA (US); Tim Swift, Albany, CA (US)

(73) Assignees: Ekso Bionics, Inc., Richmond, CA (US); The Regents of the University of California, Berkeley, CA (US)

( * ) Notice: Subject to any disclaimer, the term of this patent is extended or adjusted under 35 U.S.C. 154(b) by 957 days.

(21) Appl. No.: 15/797,060

(22) Filed: Oct. 30, 2017

(65) Prior Publication Data

US 2018/0055709 A1 Mar. 1, 2018

Related U.S. Application Data

(62) Division of application No. 13/877,805, filed as application No. PCT/US2011/055126 on Oct. 6, 2011, now Pat. No. 9,801,772.

(Continued)

(51) Int. Cl.
*A61H 3/00* (2006.01)
*A61H 1/00* (2006.01)

(Continued)

(52) U.S. Cl.
CPC ..... *A61H 1/00* (2013.01); *A61H 1/024* (2013.01); *A61H 1/0244* (2013.01); *A61H 3/00* (2013.01);

(Continued)

(58) Field of Classification Search
CPC .... A61H 3/00; A61H 3/008; A61H 2003/001; A61H 1/0237; A61H 1/024; A61H 1/0244
See application file for complete search history.

(56) References Cited

U.S. PATENT DOCUMENTS 4,697,808 A 10/1987 Larson et al.
7,153,242 B2 12/2006 Goffer (Continued)

FOREIGN PATENT DOCUMENTS

CN 101786478 7/2010
JP 2003220584 8/2003

(Continued)

OTHER PUBLICATIONS

Clarke, "*Cutting-Edge Robotic Exoskeleton Allows Wheelchair-Bound to Stand and Walk*", (Online) Feb. 4, 2010 URL:http://abcnews.go.com/GMA/Oncall/bionic-breakthrough-robotic-suit-helps-paraplegics-walk/story?id=9741496> p. 1.

(Continued)

*Primary Examiner* — Timothy A Stanis
(74) *Attorney, Agent, or Firm* — Diederiks & Whitelaw, PLC.

(57) ABSTRACT

A system and method by which movements desired by a user of a lower extremity orthotic is determined and a control system automatically regulates the sequential operation of powered lower extremity orthotic components to enable the user, having mobility disorders, to walk, as well as perform other common mobility tasks which involve leg movements, perhaps with the use of a gait aid.

14 Claims, 9 Drawing Sheets

Related U.S. Application Data

(60) Provisional application No. 61/390,438, filed on Oct. 6, 2010.

(51) Int. Cl.
*A61H 1/02* (2006.01)
*A61H 3/02* (2006.01)

(52) U.S. Cl.
CPC ..... *A61H 3/02* (2013.01); *A61H 2201/1215* (2013.01); *A61H 2201/165* (2013.01); *A61H 2201/1616* (2013.01); *A61H 2201/1642* (2013.01); *A61H 2201/5007* (2013.01); *A61H 2201/5028* (2013.01); *A61H 2201/5069* (2013.01); *A61H 2201/5079* (2013.01); *A61H 2201/5084* (2013.01); *A61H 2201/5092* (2013.01)

(56) References Cited

U.S. PATENT DOCUMENTS

| | | | | |
|---|---|---|---|---|
| 7,346,396 | B2 | 3/2008 | Barriskill et al. | |
| 7,396,337 | B2 | 7/2008 | McBean et al. | |
| 7,437,202 | B2 | 10/2008 | Morrell | |
| 7,883,546 | B2 | 2/2011 | Kazerooni et al. | |
| 7,901,368 | B2 | 3/2011 | Flaherty et al. | |
| 7,918,808 | B2 | 4/2011 | Simmons | |
| 7,947,004 | B2 | 5/2011 | Kazerooni et al. | |
| 7,998,096 | B1 | 8/2011 | Skoog | |
| 8,057,410 | B2 | 11/2011 | Angoid et al. | |
| 8,096,965 | B2 | 1/2012 | Goffer et al. | |
| 2003/0093021 | A1* | 5/2003 | Goffer | A61N 1/36003 602/23 |
| 2004/0015207 | A1* | 1/2004 | Barriskill | A61N 1/36003 607/49 |
| 2004/0246769 | A1 | 12/2004 | Ido | |
| 2006/0149338 | A1* | 7/2006 | Flaherty | A61H 1/0277 607/49 |
| 2006/0206167 | A1 | 9/2006 | Flaherty et al. | |
| 2008/0009771 | A1 | 1/2008 | Perry et al. | |
| 2009/0036804 | A1 | 2/2009 | Horst | |
| 2009/0062698 | A1 | 3/2009 | Einav et al. | |
| 2009/0131839 | A1 | 5/2009 | Yasuhara | |
| 2009/0260426 | A1 | 10/2009 | Lieberman | |
| 2010/0094188 | A1* | 4/2010 | Goffer | A61H 1/0266 602/23 |
| 2011/0066088 | A1 | 3/2011 | Little et al. | |
| 2012/0172770 | A1 | 7/2012 | Almesfer | |
| 2013/0226048 | A1 | 8/2013 | Unluhisarcikli et al. | |
| 2013/0237884 | A1 | 9/2013 | Kazerooni et al. | |
| 2014/0100492 | A1 | 4/2014 | Nagasaka | |
| 2014/0196757 | A1 | 7/2014 | Goffer | |
| 2014/0276261 | A1 | 9/2014 | Caires et al. | |

FOREIGN PATENT DOCUMENTS

| | | |
|---|---|---|
| JP | 2009273565 | 11/2009 |
| WO | 94/09727 | 5/1994 |

OTHER PUBLICATIONS

Dollar et al., "*Lower Extremity Exoskeletons and Active Orthoses: Challenges and State-of-the-Art*", IEEE Transactions on Robotics, vol. 24, No. 1, Feb. 2008 URL:http://www.eng.yale.edu/grablab/pubs/dollar_TRO_Exos.pdf>.

Veneman et al., "*Design and Evaluation of the LOPES Exoskeleton Robot for Interactive Gait Rehabilitation*", IEEE Transactions on Neutral Systems and Rehabilitation Engineering, vol. 15, No. 3, Sep. 2007.

* cited by examiner

HUMAN MACHINE INTERFACES FOR LOWER EXTREMITY ORTHOTICS

CROSS-REFERENCE TO RELATED APPLICATIONS

This application represents a divisional application of Ser. No. 13/877,805 entitled "Human Machine Interfaces for Lower Extremity Orthotics" filed Apr. 4, 2013, which is a National Stage application of PCT/US2011/055126 entitled "Human Machine Interfaces for Lower Extremity Orthotics" filed Oct. 6, 2011, which claims the benefit of U.S. Provisional Application Ser. No. 61/390,438 entitled "Human Machine Interfaces for Lower Extremity Orthotics" filed Oct. 6, 2010, all of which are incorporated herein by reference.

STATEMENT REGARDING FEDERALLY SPONSORED RESEARCH OR DEVELOPMENT

This invention was made with government support under Grant Numbers IIP0712462 and IIP0924037 awarded by the National Science Foundation and Grant Number 70NANB7H7046 awarded by the National Institute of Standards and Technology. The U.S. government has certain rights in the invention.

BACKGROUND OF THE INVENTION

Powered lower extremity orthotics, such as powered leg braces or a powered human exoskeleton, can allow a paraplegic patient to walk, but require a means by which to communicate what action the exoskeleton should make. Because some of the users are completely paralyzed in one or both legs, the exoskeleton control system must determine which leg the user would like to move and how they would like to move it before the exoskeleton can make the proper motion. These functions are achieved through a human machine interface (HMI) which translates motions by the person into actions by the orthotic. The invention is concerned with the structure and operation of HMIs for lower extremity orthotics.

SUMMARY OF THE INVENTION

The present invention is directed to a system and method by which a lower extremity orthotic control system determines a movement desired by a user and automatically regulates the sequential operation of powered lower extremity orthotic components, particularly with a user employing gestures of their upper body or other signals to convey or express their intent to the system. This is done in order to enable people with mobility disorders to walk, as well as perform other common mobility tasks which involve leg movements. The invention has particular applicability for use in enabling a paraplegic to walk through the controlled operation of a human exoskeleton.

In accordance with the invention, there are various ways in which a user can convey or input desired motions for their legs. A control system is provided to watch for these inputs, determine the desired motion and then control the movement of the user's legs through actuation of an exoskeleton coupled to the user's lower limbs. Some embodiments of the invention involve monitoring the arms of the user in order to determine the movements desired by the user. For instance, changes in arm movement are measured, such as changes in arm angles, angular velocity, absolute positions, positions relative to the exoskeleton, positions relative to the body of the user, absolute velocities or velocities relative the exoskeleton or the body of the user. In other embodiments, a walking assist or aid device, such as a walker, a forearm crutch, a cane or the like, is used in combination with the exoskeleton to provide balance and assist the user desired movements. The same walking aid is linked to the control system to regulate the operation of the exoskeleton. For instance, in certain preferred embodiments, the position of the walking aid is measured and relayed to the control system in order to operate the exoskeleton according to the desires of the user. For instance, changes in walking aid movement are measured, such as changes in walking aid angles, angular velocity, absolute positions, positions relative to the exoskeleton, positions relative to the body of the user, absolute velocities or velocities relative the exoskeleton or the body of the user.

In general, disclosed here is a system which determines the desired movement and automatically regulates the sequential operation of powered lower extremity orthotic components by keeping track of the current and past states of the system and making decisions about which new state is desired using various rules. However, additional objects, features and advantages of the invention will become more readily apparent from the following detailed description of various preferred embodiments when taken in conjunction with the drawings wherein like reference numerals refer to corresponding parts in the several views.

DETAILED DESCRIPTION OF THE INVENTION

This invention is concerned with having a lower extremity orthotic control system make decisions on how to control a lower extremity orthotic, such as an exoskeleton, based on inputs by which the user communicates his or her intended motion to the exoskeleton. In particular, input from sensors are interpreted to determine what action the person wants to make. In the preferred embodiment, the sensor inputs are read into a finite state machine which determines allowable transitions and if predetermined conditions for the transition have been met.

Figure 1:
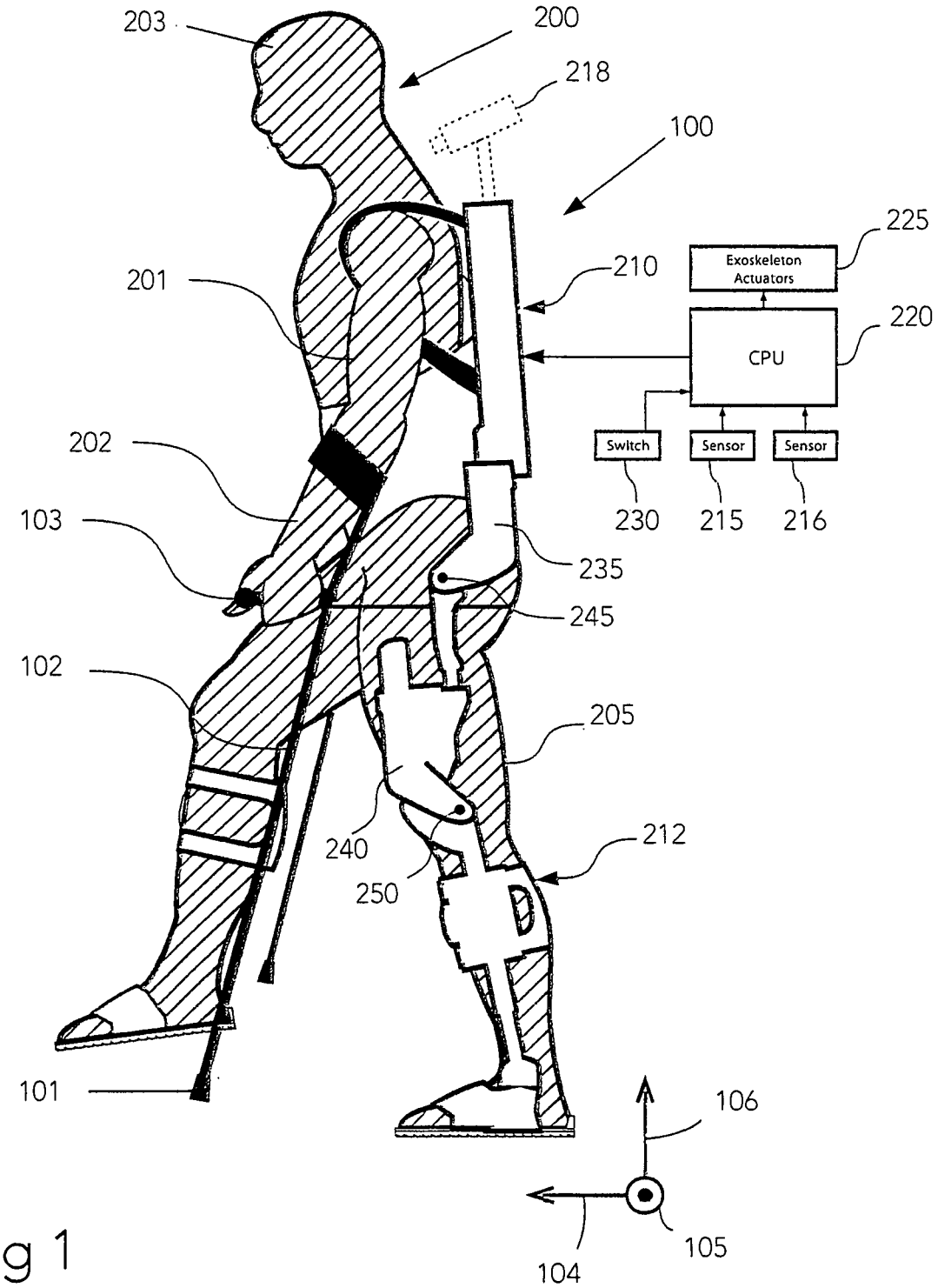
FIG. 1 is a schematic side view of a handicapped individual coupled to an exoskeleton and utilizing a walking aid in accordance with the invention.

With initial reference to FIG. 1, a lower extremity orthotic is shown, in this case an exoskeleton 100 having a waist or trunk portion 210 and lower leg supports 212 which is used in combination with a crutch 102, including a lower, ground engaging tip 101 and a handle 103, by a person or user 200 to walk. The user 200 is shown to have an upper arm 201, a lower arm (forearm) 202, a head 203 and lower limbs 205. In a manner known in the art, trunk portion 210 is configurable to be coupled to an upper body (not separately labeled) of the person 200, the leg supports 212 are configurable to be coupled to the lower limbs 205 of the person 200 and actuators, generically indicated at 225 but actually interposed between portions of the leg supports 212 as well as between the leg supports 212 and trunk portion 210 in a manner widely known in the art, for shifting of the leg supports 212 relative to the trunk portion 210 to enable movement of the lower limbs 205 of the person 200. In the example shown in FIG. 1, the exoskeleton actuators 225 are specifically shown as a hip actuator 235 which is used to move hip joint 245 in flexion and extension, and as knee actuator 240 which is used to move knee joint 250 in flexion and extension. As the particular structure of the exoskeleton can take various forms, is known in the art and is not part of the present invention, it will not be detailed further herein. However, by way of example, a known exoskeleton is set forth in U.S. Pat. No. 7,883,546, which is incorporated herein by reference. For reference purposes, in the figure, axis 104 is the "forward" axis, axis 105 is the "lateral" axis (coming out of the page), and axis 106 is the "vertical" axis. In any case, in accordance with certain embodiments of the invention, it is movements of upper arm 201, lower arm 202 and/or head 203 which is sensed and used to determine the desired movement by user 200, with the determined movement being converted to signals sent to exoskeleton 100 in order to enact the movements. More specifically, by way of example, the arms of user 200 are monitored in order to determine what the user 200 wants to do. In accordance with the invention, an arm or arm portion of the user is defined as one or more body portions between the palm to the shoulder of the user, thereby particularly including certain parts such as forearm and upper arm portions but specifically excluding other parts such as the user's fingers. In one preferred embodiment, monitoring the user's arms constitutes determining changes in orientation such as through measuring absolute and/or relative angles of the user's upper arm 201 or lower arm 202 segment. Absolute angles represent the angular orientation of the specific arm segment to an external reference, such as axes 104-106, gravity, the earth's magnetic field or the like. Relative angles represent the angular orientation of the specific arm segment to an internal reference such as the orientation of the powered exoskeleton or the user themselves. Measuring the orientation of the specific arm segment or portion can be done in a number of different ways in accordance with the invention including, but not limited to, the following: angular velocity, absolute position, position relative to the powered exoskeleton, position relative to the person, absolute velocity, velocity relative to the powered exoskeleton, and velocity relative to the person. For example, to determine the orientation of the upper arm 201, the relative position of the user's elbow to the powered exoskeleton 100 is measured using ultrasonic sensors. This position can then be used with a model of the shoulder position to estimate the arm segment orientation. Similarly, the orientation could be directly measured using an accelerometer and/or a gyroscope fixed to upper arm 201. Generically, FIG. 1 illustrates sensors employed in accordance with the invention at 215 and 216, with signals from sensors 215 and 216 being sent to a controller or signal processor 220 which determines the movement intent or desire of the user 200 and regulates exoskeleton 100 accordingly as further detailed below.

The simplest "sensor" set (215, 216) is a set of buttons, which can be operated by a second person. In the typical case, the second person would be a physical therapist. These buttons may be located on a "control pad" (e.g., switches 230) and used to select desired states. In some embodiments a single button could be used to trigger the next state transition. This could allow the second person to manually regulate the timing of the walking cycle. The allowable states are preferably limited for safety and governed by the current state, as well as the position of the body.

The sensors 215 and 216, at least in accordance with the most preferred embodiments of the invention, involve instrumenting or monitoring either the user's arms (as previously discussed) or a walking aid (i.e., crutches, walker, cane) in order to get a rough idea of the movement of the walking aid and/or the loads on the walking aid in order to determine what the user wants to do. The techniques are applicable to any walking aid. However, to fully illustrate the invention, a detailed description will be made with exemplary reference to the use of forearm crutch 102. Still, one skilled in the art should readily recognize that the techniques can also be applied to other walking aids, such as walkers and canes. Additionally, many of the methods also apply for walking on parallel bars (which does not need a walking aid) by instrumenting the user's arms.

In general, a system is provided that includes hardware which can sense the relative position of a crutch tip with respect to the user's foot. With this arrangement, the crutch's position is roughly determined by a variety of ways such as using accelerometer/gyro packages or using a position measuring system to measure the distance from the orthotic or exoskeleton to the crutch. Such a position measuring system could be one of the following: ultrasonic range finders, optical range finders, and many others, including signals received from an exoskeleton mounted camera 218. The crutch position can also be determined by measuring the absolute and/or relative angles of the user's upper, lower arm, and/or crutch 102. Although one skilled in the art will recognize that there are many other ways to determine the position of the crutch 102 with respect to the exoskeleton, discussed below are arrangements considered to be particularly advantageous.

Figure 2:
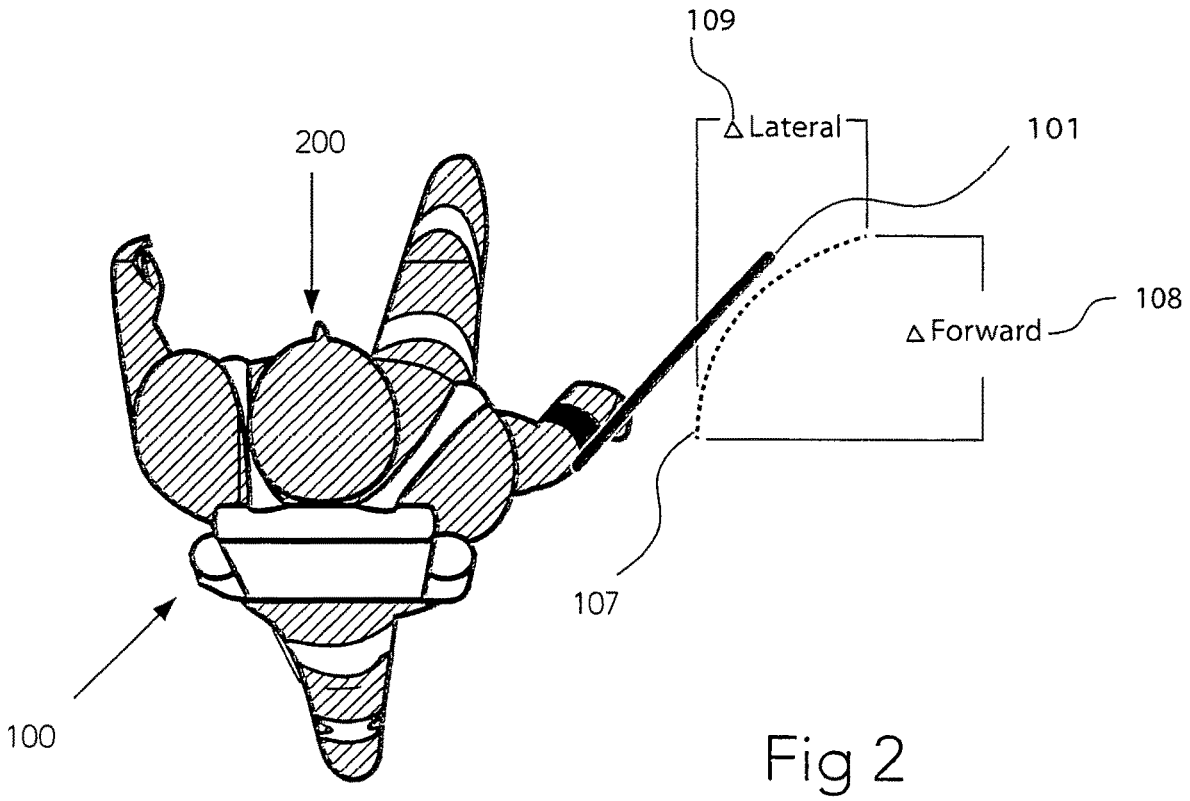
FIG. 2 is a top view of the individual, exoskeleton and walking aid of FIG. 1.

In one rather simple embodiment, the approximate distance the crutch 102 is in front or behind the exoskeleton (i.e., along forward axis 104 in FIG. 1) is measured. That is, in one particular system, only a single dimensional estimate of the distance between the crutches and the exoskeleton in the fore and aft direction is needed. Other systems may measure position in two dimensions (such as long forward axis 104 and lateral axis 105), or even three dimensions (104, 105, and 106) for added resolution. The measured position may be global or relative to the previous point or a point on the system. An example of measuring a crutch motion in two directions is shown in FIG. 2 where the path of a crutch tip motion is shown as path 107. The distance 108 is the distance traversed by path 107 in the direction of the forward axis 104, and the distance 109 is the distance traversed by path 107 in the direction of the lateral axis 105.

Also, most of the techniques disclosed here assume that there is some method of determining whether the user's foot and the crutch is in contact with the ground. This is useful for determining safety, but is not necessary and may slow the gait. Impact sensors, contact sensors, proximity sensors, and optical sensors are all possible methods for detecting when the feet and/or crutches are on the ground. One skilled in the art will note that there are many ways to create such sensors. It is also possible to use an orientation sensor mounted on the crutch to determine when contact with the ground has occurred by observing a sudden discontinuous change in motion due to contact with the ground, or by observing motion or a lack thereof that indicates the crutch tip is constrained to a point in space. In this case two sensors (orientation and ground contact) are combined into one. However, a preferred configuration includes a set of crutches 102 with sensors 215, 216 on the bottoms or tips 101 to determine ground contact. Also included is a method of measuring the distance between crutches 102, such as through an arm angle sensor. Furthermore, it may include foot pressure sensors. These are used to determine the desired state based on the current state and the allowable motions given the configuration as discussed more fully below.

Regardless of the particular types of sensor employed, in accordance with the invention, the inputs from such sensors 215, 216 are read into a controller or central processing unit (CPU) 220 which stores both the present state of the exoskeleton 100 and past states, and uses those to determine the appropriate action for the CPU 220 to take next in controlling the lower extremity orthotic 100. One skilled in the art will note that this type of program is often referred to as a finite state machine, however there are many less formal methods to create such behaviors. Such methods include but are not limited to: case statements, switch statements, look-up tables, cascaded if statements, and the like.

Figure 3:
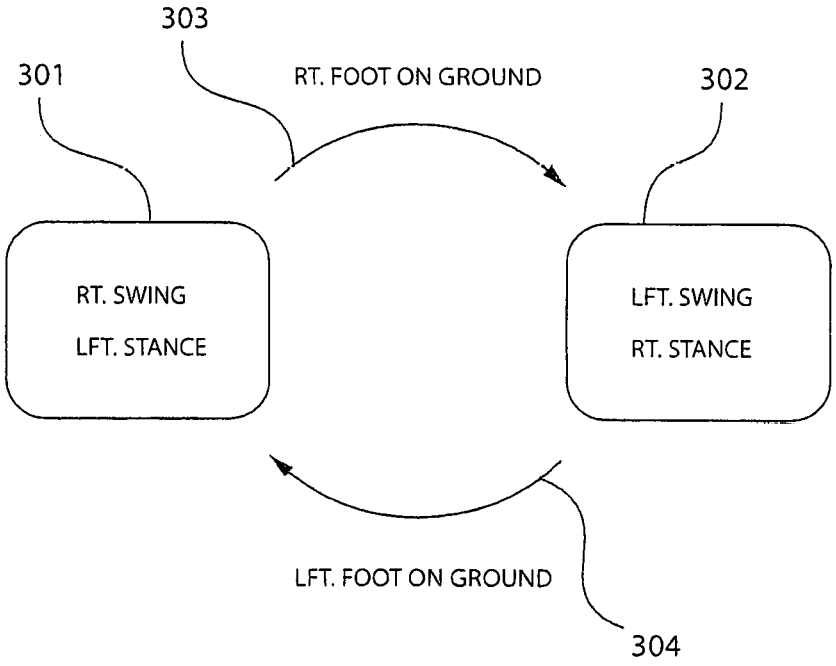
FIG. 3 schematically illustrates a simple state machine with two states.

At this point, the control implementation will be discussed in terms of a finite state machine which determines how the system will behave. In the simplest version, the finite state machine has two (2) states. In the first, the left leg is in swing and the right leg is in stance. In the second, the right leg is in swing and the left leg is in stance (FIG. 1). The state machine of controller 220 controls when the exoskeleton 100 switches between these two states. This very simple state machine is illustrated in FIG. 3 where 301 represents the first state, 302 represents the second state, and the paths 303 and 304 represent transitions between those states.

Figure 4:
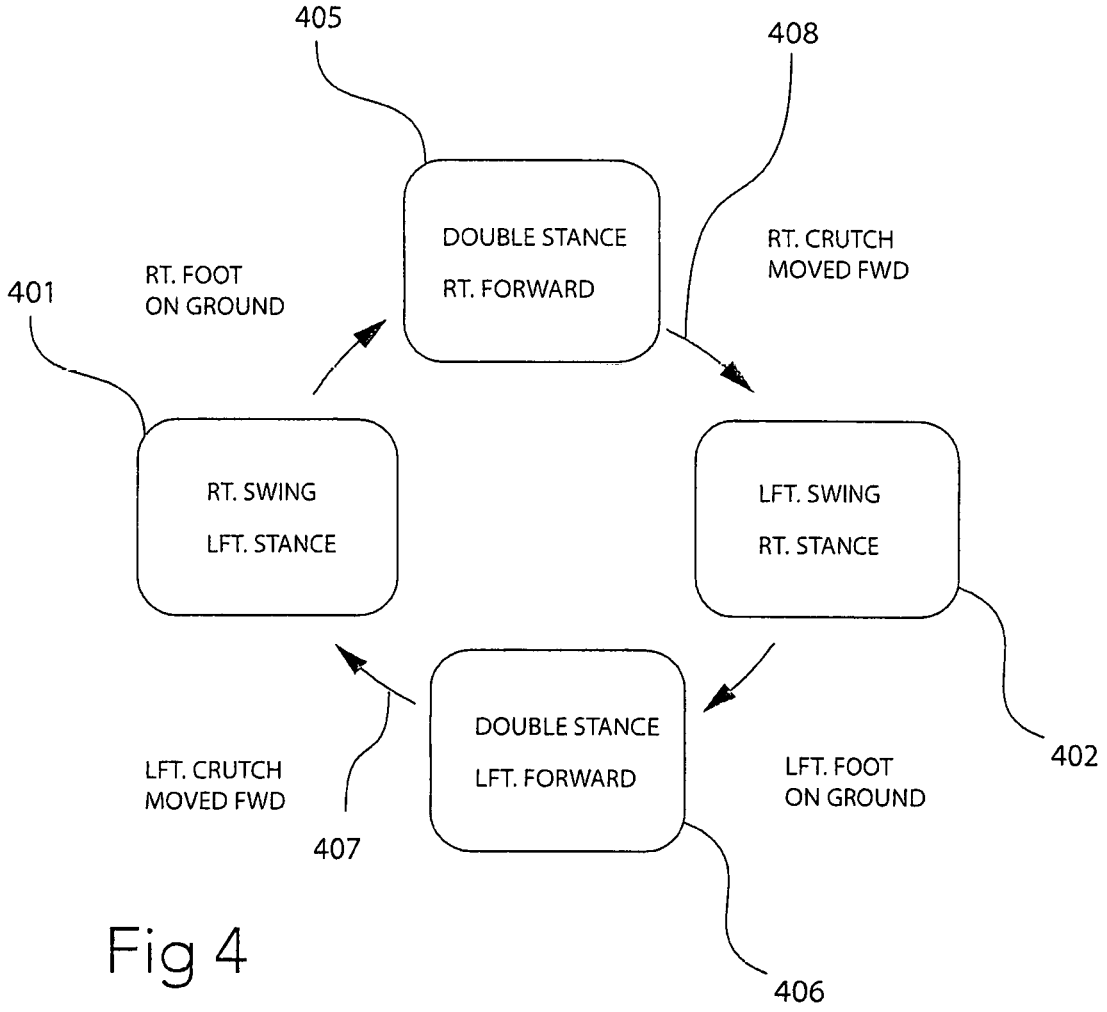
FIG. 4 schematically illustrates a state machine with more states.

Further embodiments of the state machine allow for walking to be divided into more states. One such arrangement employs adding two double stance states as shown in FIG. 4. These states are indicated at 405 and 406 and occur when both feet are on the ground and the two states distinguish which leg is in front. Furthermore, the state machine, as shown in FIG. 4, adds user input in the form of crutch orientation. In this embodiment, the right and left swing states 401 and 402 are only entered when the user has indicated they would like to take a step by moving the crutch 102 forward, as represented by transitions 407 and 408 respectively. It is important to note that the left and right leg can use independent state machines that check the other leg state as part of their conditions to transition between states for safety. This would produce the same results as the single state machine.

For clarity, a typical gait cycle incorporates of the following steps. Starting in state 405, the user moves the right crutch forward and triggers transition 408 when the right crutch touches the ground. Thereafter, state 402 is entered wherein the left leg is swung forward. When the left leg contacts the ground, state 406 is entered. During state 406, the machine may make some motion with both feet on the ground to preserve forward momentum. Then, the user moves the left crutch forward and triggers transition 407 when the left crutch touches the ground. Then the machine enters state 401 and swings the right leg forward. When the right leg contacts the ground, the machine enters state 405. Continuing this pattern results in forward locomotion. Obviously, an analogous state machine may enable backwards locomotion by reversing the direction of the swing leg motions when the crutch motion direction reverses.

At this point, is should be noted that the stance phases may be divided into two or more states, such as a state encompassing heel strike and early stance and a state encompassing late stance and push off. Furthermore, each of these states may have sub-states, such as flexion and extension as part of an overall swing.

Using a program that operates like a state machine has important effects on the safety of the device when used by a paraplegic, because it insures that the device proceeds from one safe state to another by waiting for appropriate input from the user to change the state, and then only transitioning to an appropriate state which is a small subset of all of the states that the machine has or that a user might try to request. This greatly reduces the number of possible state transitions that can be made and makes the behavior more deterministic. For example, if the system has one foot swinging forward (such as in state 401 of FIG. 4), the system is looking for inputs that will tell it when to stop moving that foot forward (and transition to a double stance state such as 405) rather than looking or accepting inputs that would tell it to lift the other foot (such as moving directly to state 402).

Figure 5:
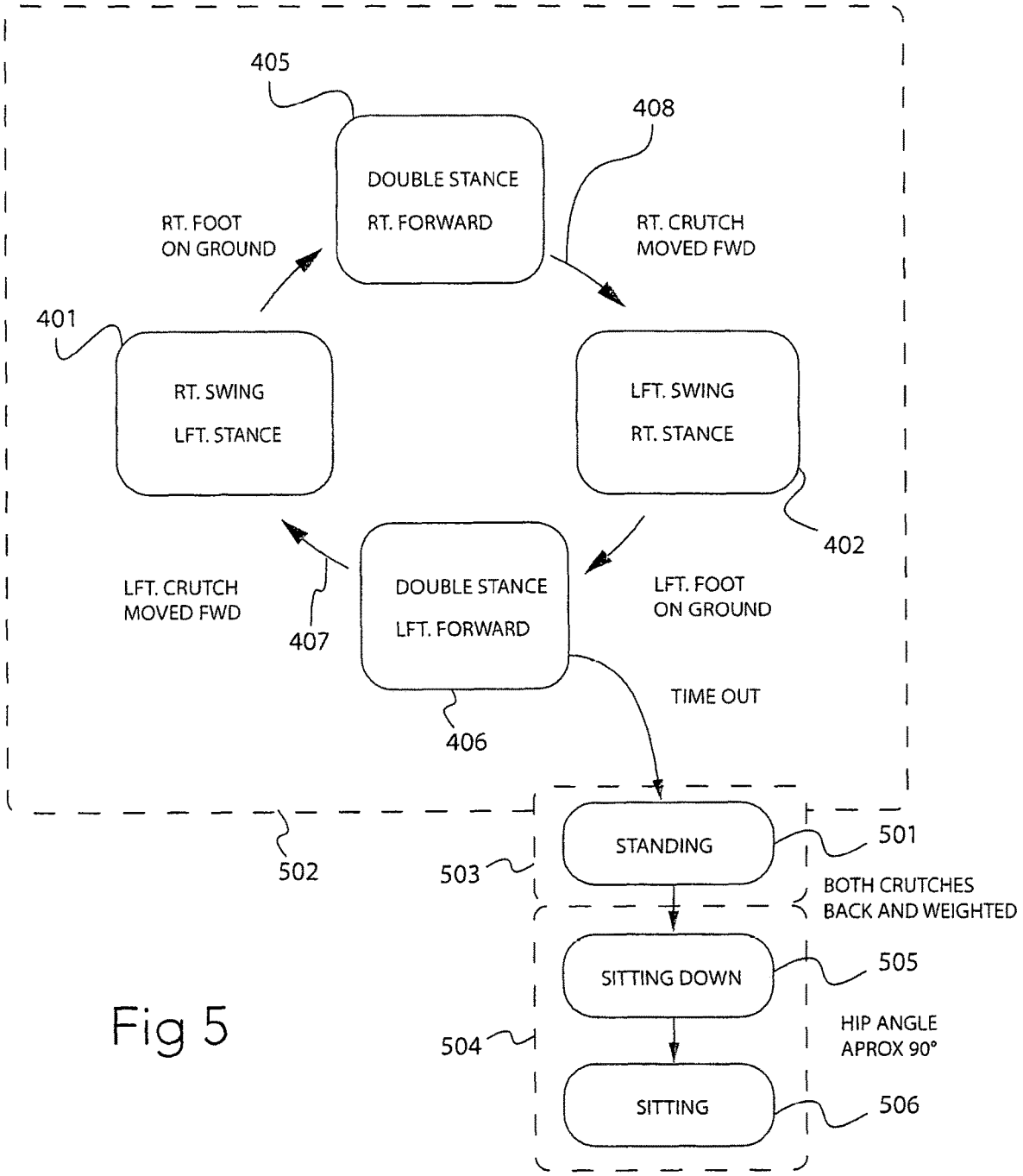
FIG. 5 represents a state machine illustrating 3 modes.

Extensions of the state machine also include additional states that represent a change in the type of activity the user is doing such as: sit down, stand up, turn, stairs, ramps, standing stationary, and any other states the user may need to use the exoskeleton during operation. We refer to these different activities as different "modes" and they represent moving from one part of the state machine to another. FIG. 5 shows a portion of one such state machine comprised of three modes, i.e., walking mode 502, standing mode 503, and sitting mode 504. In some cases, a mode may be comprised of only one state, such as in standing mode 503. In the embodiment shown in FIG. 5, when the user is in the standing state 501, the user may signal "sit down" by putting the crutches behind them and weight on the crutches, then the exoskeleton transitions into sitting mode 504 and sitting down state 505, which automatically transitions into the sat or sitting state 506 when the sitting maneuver is complete. In this embodiment, the completion of the sitting maneuver is signaled by the hip angle as measured by the exoskeleton crossing a pre-determined threshold. It is important to understand that, for reasons of clarity, these figures do not show complete embodiments of the state machines required to allow full mobility. For example, FIG. 5 does not include a way to stand from a sitting position, but the states necessary to stand are clearly an extension of the methods used in sitting. For instance, just as putting both crutches behind them and weighting them while standing is a good way for a user to signal that they want to sit down, putting both crutches behind them and weighting the crutches while sitting is a good way for a user to signal that they want to stand up.

Figure 6:
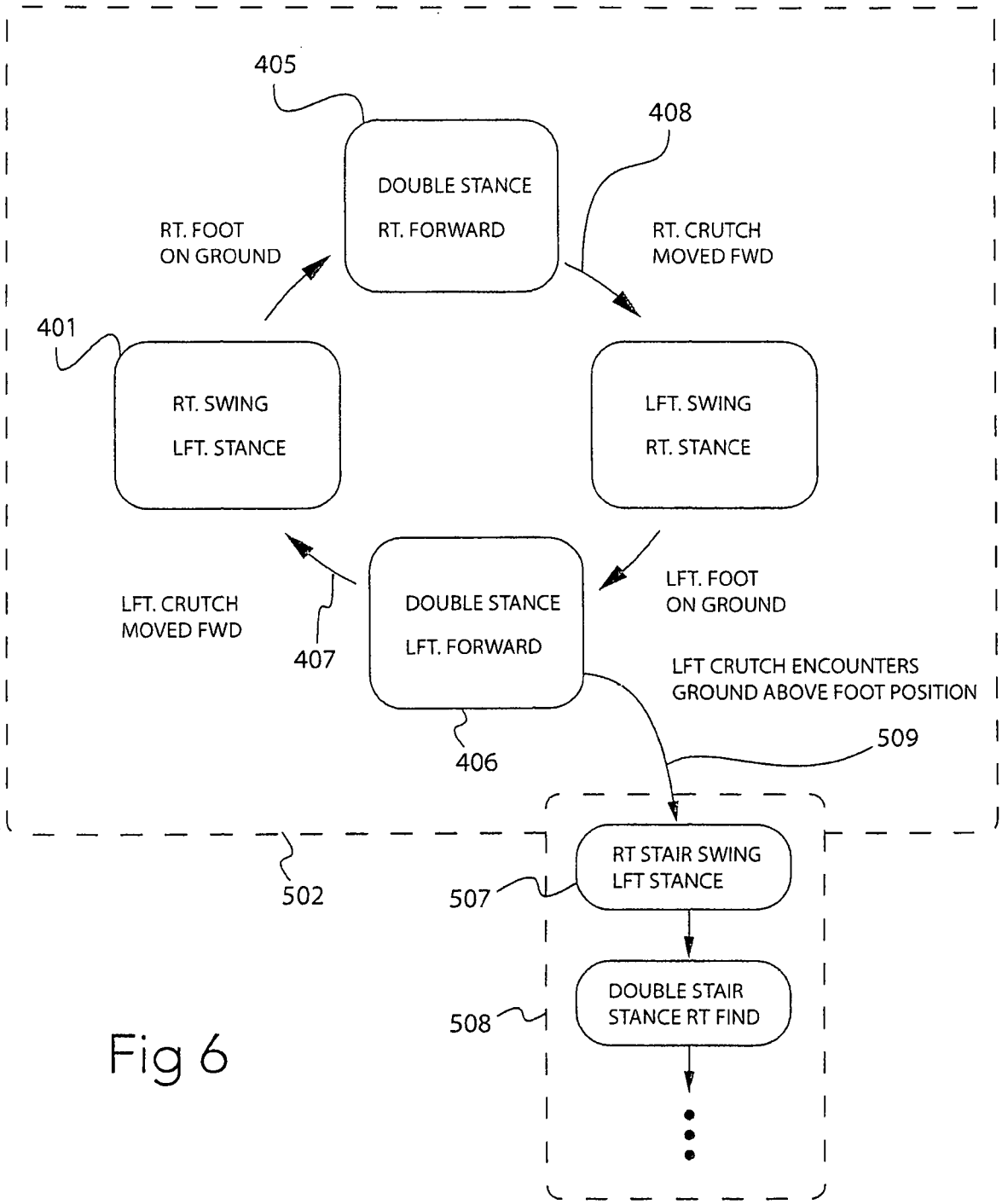
FIG. 6 is a state machine illustrating a stairclimbing embodiment.
Figure 6A:
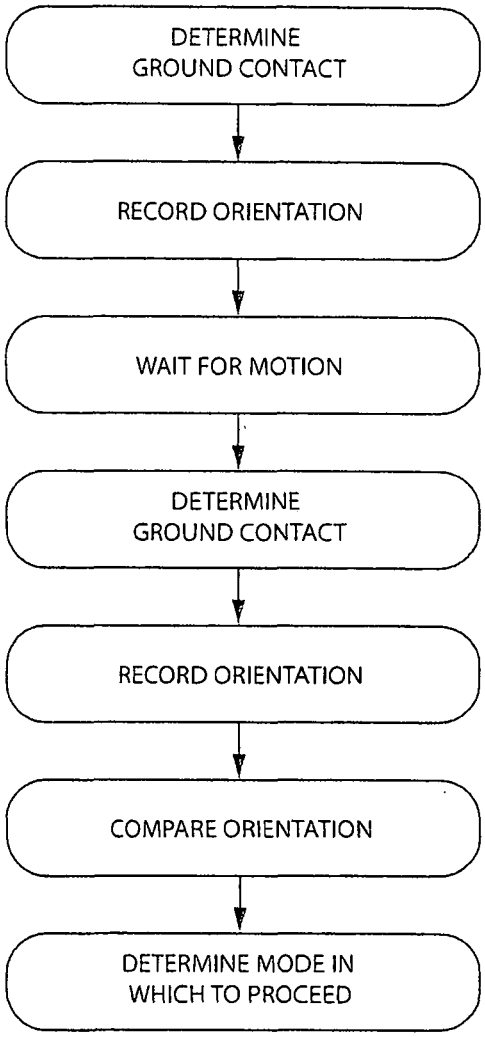
FIG. 6*a* sets forth a transition decision algorithm for the invention.

Another such change in modes is beginning to climb stairs. A partial state machine for this activity change is shown in FIG. 6. In this embodiment, when the crutch hits the ground, but it encounters the ground substantially above the current foot position, i.e., at a higher position along vertical axis 106 in FIG. 1, during walking or standing, the exoskeleton would transition into a stair mode by moving into "right stair swing left stair stance" state 507 within "stair climbing mode" 508 shown in FIG. 6. FIG. 6*a* shows a flow chart of how the decision can be made to choose between transitions 407 and 509.

By this point, the main discussions concern the use of sensor input to regulate state and mode changes. Central Processing Unit 220 can also use sensors, such as sensors 215, 216, to modify the gait parameters which are used by CPU 220 when taking an action. For example, during walking the crutch sensors could modify the system's step length. For example, CPU 220 using the state machine shown in FIG. 4 could also use the distance that a crutch was moved in order to determine the length of the step trajectory to carryout when operating in state 401 or state 402. The step length could be any function of the distance the crutch is moved, but preferably a proportional function of the distance 108 shown in FIG. 2. This arrangement advantageously aids with turning or obstacle avoidance as the step length then becomes a function of the crutch motion. If one crutch is moved farther than the other, the corresponding step will be longer and thus the user will turn.

Instead of just using a proportional function, the desired mapping from crutch move distance 108 to step length can be estimated or learned using a learning algorithm. This allows the mapping to be adjusted for each user using a few training steps. Epsilon greedy and nonlinear regression are two possible learning algorithms that could be used to determine the desired step length indicated by a given crutch move distance. When using such a method, a baseline mapping would be set, and then a user would use the system providing feedback as to whether they felt each successive step were longer than they had desired or shorter than they had desired. This occurs while the resulting step lengths are being varied. With such an arrangement, this process could be employed to enable the software to learn a preferred mapping between crutch move distance 108 and step length. In a related scenario, the sensors can also indicate the step speed by mapping the velocity of the crutch tip or the angular velocity of the arm to the desired step speed in much the same way as the step length is mapped.

Obstacles can be detected by the motion of the crutch and/or sensors located in the crutch tip 101 or foot. These can be avoided by adjusting the step height and length parameter. For example, if the path 107 shown in FIG. 2 takes an unexpected circuitous route to its termination (perhaps in a type of motion that the user has been instructed to use in order to communicate with the machine) then CPU 220 could use different parameters to carry out the step states 405 or 407 shown in FIG. 4, like raising the foot higher for extra clearance. One should note, however, that when the motion of the crutch deviates greatly from that expected, it is desired to have the exoskeleton 100 transition into a "safe stand" state in case the user is having other problems than simple obstacles.

In an alternative arrangement, the path of the swing leg is adjusted on each step by observing how high the crutch is moved during the crutch movement before the step. This arrangement is considered to be particularly advantageous in connection with clearing obstacles. For example, if the user moves the crutch abnormally high up during crutch motion, the maximum height of the step trajectory is increased so that the foot also moves higher upward than normal during swing. As a more direct method, sensors could be placed on the exoskeleton to measure distance to obstacles directly. The step height and step distance parameters used in stair climbing mode could be adjusted based on how the crutch is moved as well. For example, if the crutch motion terminates at a vertical position, along axis 106, which was higher than an initial position by, say, 6 inches, the system might conclude that a standard stair step is being ascended and adjust parameters accordingly. The algorithm for this decision is again shown in the flow chart of FIG. 6*a*. This method is more applicable for stair climbing than clearing obstacles, but uses the same basic principal of tracking how high the crutch moves.

The stair can also be detected by determining where the exoskeleton foot lands along axis 106 of FIG. 1. For example, if the exoskeleton swing leg contacts the ground substantially above the current stance foot, it could transition into a stair climbing mode. If the exoskeleton swing leg contacts the ground substantially below the current stance foot as measured along axis 106, it could transition into a stair descending mode.

Figure 7:
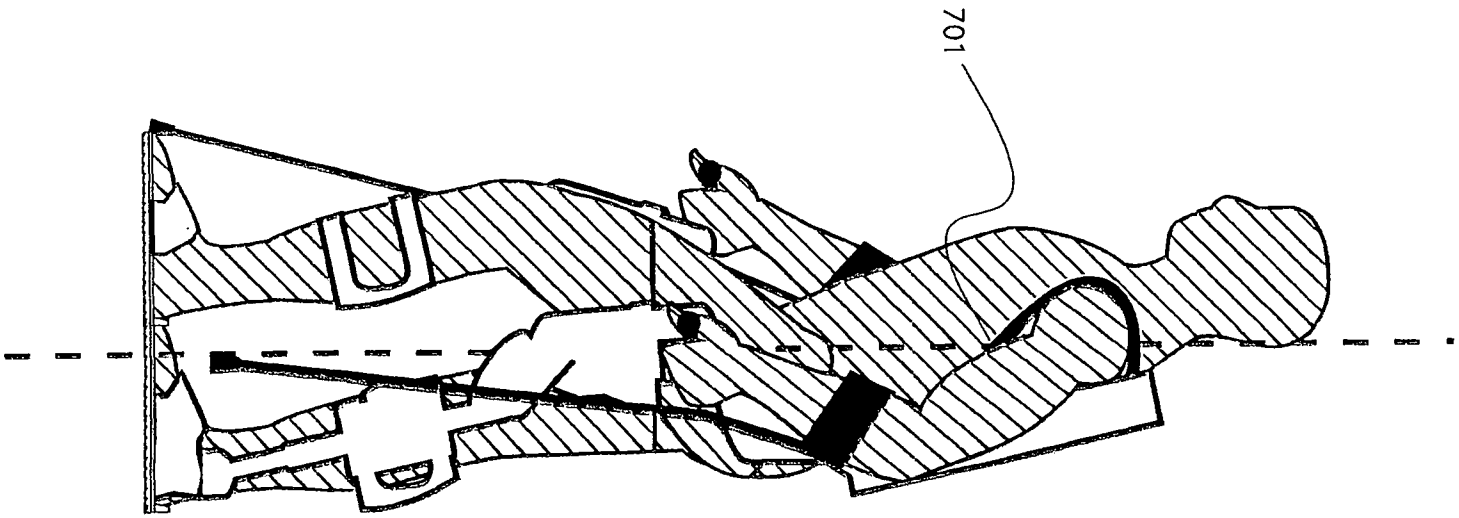
FIG. 7 is an illustration of a planar threshold for triggering a step.

Returning to the transitions between states, the conditions necessary to transition from one state to another can be chosen in a number of manners. First, they can be decided based on observing actions made by the user's arm or crutch. The primary embodiment is looking for the crutch to leave the ground observing how far and/or how fast it is moved, waiting for it to hit the ground, and then taking a step with the opposite leg. However, waiting for the crutch to hit the ground before initiating a step could interfere with a fluid gait and therefore another condition may be used to initiate the step. In an alternative embodiment, the system observes the crutch swinging to determine when it has moved through a threshold. When the crutch passes through this threshold, the step is triggered. A suitable threshold could be a vertical plane passing through the center of the user. Such a plane is indicated by the dotted line 701 in FIG. 7. When the crutch moves through this plane, it is clear that the next step is desired, and the step would be initiated. Other thresholds of course can be used. For instance, as stated previously, a sensor measuring arm angle could be used in place of actual crutch position. In this case, the arm angle could be observed until it passes through a suitable threshold and then the next step would be initiated. This mode is compatible with the state machine shown in FIG. 4, however, the criteria for the transitions (such as 407 and 408) to achieve "crutch moved forward" is that the crutch passes the threshold rather than contacts the ground.

Figure 8:
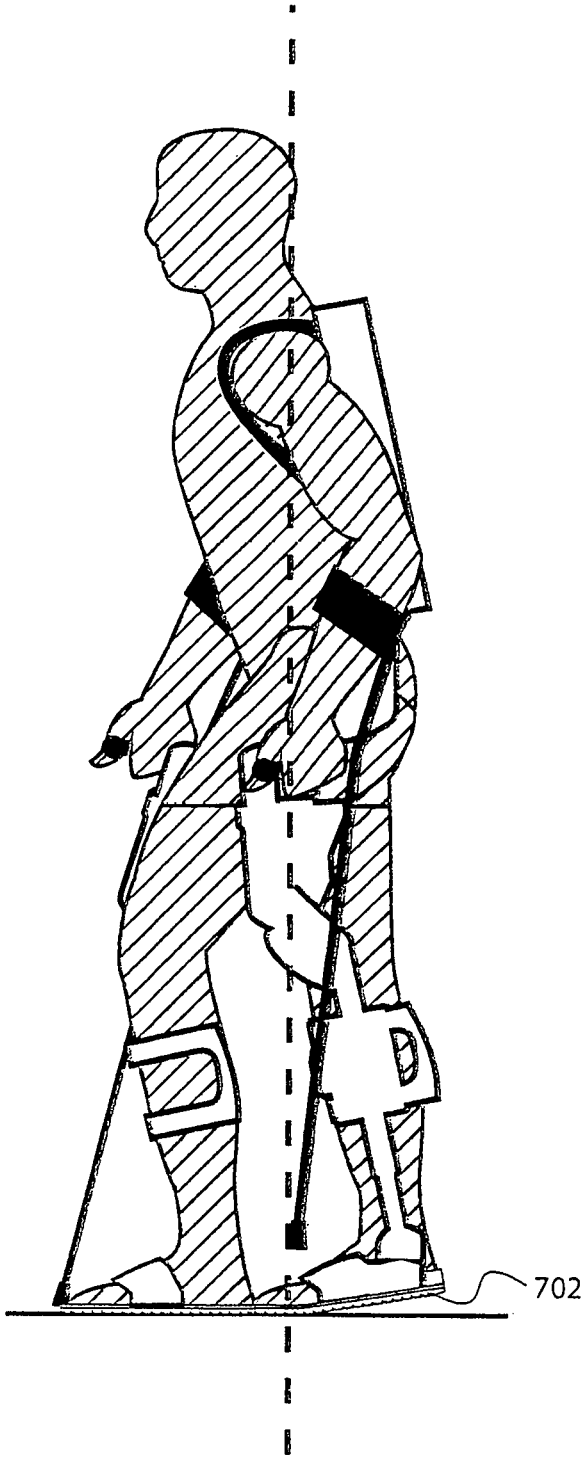
FIG. 8 is an illustration of a heel rise used to trigger a step.

Foot sensors can also be used to create state transitions that will not require the system to put the crutch down before lifting the foot. With reference to FIG. 8, when the heel 702 of the next swing leg is lifted off of the ground, a step is triggered. For safety, the state of the other foot can be checked before starting the step to ensure that it is on the ground or to make sure a significant amount of weight has been transferred to the other foot. Combining these for added safety, in order to take a left step, the right arm first moves forward in front of the left arm and past a set threshold, and the left foot heel has come off of the ground while the right foot remains on the ground. When these conditions are met, the left leg takes a step.

In accordance with another method exemplified in connection with taking a left step, the right arm swings forward faster than a set threshold and past a specified angle (or past the opposite arm). If the heel of the swing (left) foot is also unloaded, then the step is taken. In accordance with a preferred embodiment, this arrangement is implemented by measuring the right arm's angular velocity and angular position, and comparing both to threshold values.

These methods all can be used to get a more fluid gait, but in order to make it the most fluid possible, a state machine with a "steady walking" mode might be desired. This mode could be entered after the user had indicated a few consistent steps in a row, thereby indicating a desire for steady walking. In a "steady walking" mode the exoskeleton would do a constant gait cycle just as an ordinary person would walk without crutches. The essential difference in this part of the state machine would be that the state transitions would be primarily driven by timing, for instance at time=x+0.25 start swing, at time=x+0.50 start double stance, etc. However, for this to be safe, the state machine also needs transitions which will exit this mode if the user is not keeping up with the timing, for example, if a crutch is not lifted or put down at the proper time.

Another improvement to these control methods is the representation of the state machine transitions as weighted transitions of a feature vector as opposed to the discrete transitions previously discussed. The state machine previously discussed uses discrete state triggers where certain state criteria must be met before the transitions are triggered. The new structure incorporates an arbitrary number of features to estimate when the states should trigger based on the complete set of state information. For example, the state transition from swing to stance was originally represented as just a function of the crutch load and arm angle, but another method can incorporate state information from the entire device. In particular:

Discrete Transition: $T=(F_{Crutch}>F_{Threshold})\&(\theta_{Arm}>\theta_{Threshold})$ Weighted Transition: $A_{Trigger}=\omega_{Trigger}*F_{State}$; $A_{NoTrigger}=\omega_{NoTrigger}*F_{State}$ $T=(A_{Trigger}>A_{NoTrigger})$ where $A_i$=Activation value of the indicated classification $\omega_i$=Weighting vector of a No Trigger state $F_{State}$=Feature vector of the current device state, where the feature vector includes any features that may be of interest, such as the crutch force, the lean angle, or the foot position T=Trigger flag of when to switch state (1 indicates switch state 0 indicates no action)

This method is then used with machine learning techniques to learn the most reliable state transitions. Using machine learning to determine the best weighting vector for the state information will incorporate the probabilistic nature of the state transitions by increasing the weight of the features with the strongest correlation to the specific state transition. The formulation of the problem can provide added robustness to the transition by incorporating sensor information to determine the likelihood that a user wants to transition states at this time. By identifying and utilizing additional sensor information into the transitions, the system will at least match robust as the discrete transitions discussed previously if the learning procedure determines that the other sensor information provides no new information.

Another method for considering safety is using reachability analysis. Hybrid control theory offers another method to ensure that the HMI only allows for safe transitions. Reachability analysis determines if the machine can move the person from an initial state (stored in a first memory) to a safe final state (stored in a second memory) given the limitations on torque and angular velocity. This method takes into account the dynamics of the system and is thus more broadly applicable than the center of mass method. When the person is about to take a step, the controller determines if the person can proceed to another safe state or if the request step length is reachable. If it is not safe or reachable, the controller makes adjustments to the person's pose or adjusts the desired target to make the step safe. This method can also be used during maneuvers, such as standing.

The back angle in the coronal plane can also be used to indicate a desire to turn. When the user leans to the left or right, that action indicates a desire to turn that direction. The lean may be measured in the coronal plane (i.e., that formed by axes 105 and 106). Likewise, the head angle in the transverse plane (that formed by axes 104 and 105) can also be used in a similar manner. Furthermore, since the back angle can be measured, the velocity or angular velocity of the center of mass in the coronal plane can also be measured. This information can also be used to determine the intended turn and can be measured by a variety of sensors, including an inertial measurement unit.

As an alternative to measuring the angle or angular velocity, the torque can also be measured. This also indicates that the body is turning in the coronal plane and can be used to determine intended turn direction. There are a number of sensors which can be used for this measurement, which one skilled in the art can implement. Two such options are a torsional load cell or pressure sensors on the back panel which measure differential force.

Although described with reference to preferred embodiments of the invention, it should be recognized that various changes and/or modifications of the invention can be made without departing from the spirit of the invention. In particular, it should be noted that the various arrangements and methods disclosed for use in determining the desired movement or intent of the person wearing the exoskeleton could also be used in combination with each other such that two or more of the arrangements and methods could be employed simultaneously, with the results being compared to confirm the desired movements to be imparted. In any case, the invention is only intended to be limited by the scope of the following claims.

We claim:

1. A powered lower extremity orthotic, configurable to be coupled to a person, said powered lower extremity orthotic comprising:

an exoskeleton including, a waist portion configurable to be coupled to an upper body of the person, leg supports configurable to be coupled to lower limbs of the person and actuators for shifting of the leg supports relative to the waist portion to enable movement of the lower limbs of the person;

a gait aid for use in further supporting the person;

a controller configured to receive an intended motion of the person from a human machine interface configured to estimate the intended motion by directly observing motion of an upper arm, a lower arm or a palm of a hand of the person;

said controller further configured to monitor which of the leg supports of said powered lower extremity orthotic are in contact with the ground;

said controller further configured to store in a memory a current state of the powered lower extremity orthotic, said current state containing information including which of said leg supports are in contact with the ground, if the gait aid is in contact with the ground, and a sequence in which said leg supports and the gait aid contacted the ground;

said controller further configured to maintain, in the memory, a set of safe states to which the powered lower extremity orthotic can transition from the current state without causing the person to fall;

said controller further configured to wait until the intended motion appears to request one of said safe states; and said controller further configured to transition to said one of said safe states.

2. The powered lower extremity orthotic of claim 1, wherein said safe states in said memory are determined through reachability analysis.

3. The powered lower extremity orthotic of claim 1, wherein said leg supports include sensors that are configured to measure a first distribution of weight on the ground when said leg supports contact the ground and are also configured to measure a second distribution of weight on the ground when said gait aid contacts the ground; and said controller being further configured to determine said set of safe states based on said first and second weight distributions on the ground.

4. The powered lower extremity orthotic of claim 1, wherein the exoskeleton has a camera and said human machine interface is configured to estimate the intended motion by observing, with the camera, motion of an upper arm, a lower arm or a palm of a hand of the person.

5. The powered lower extremity orthotic of claim 1, wherein said human machine interface is configured to estimate the intended motion by directly observing motion of the gait aid.

6. A powered lower extremity orthotic, configurable to be coupled to a person, said powered lower extremity orthotic comprising:

an exoskeleton including a waist portion configurable to be coupled to an upper body of the person, at least one leg support configurable to be coupled to at least one lower limb of the person and at least one actuator for shifting of the at least one leg support relative to the waist portion to enable movement of the at least one lower limb of the person;

a controller configured to receive an intended motion of the person from a human machine interface that is configured to estimate the intended motion by directly observing motion of an upper arm, a lower arm or a palm of a hand of the person;

said controller further configured to maintain a plurality of states representing various gait cycles and phases of the gait cycles;

said controller further configured to maintain at least one transition from each of said plurality of states to at least one other of said plurality of states, said at least one transition being allowed to be taken based on the intended motion and said plurality of states;

said controller further configured to operate said powered lower extremity orthotic in a current state until conditions of said at least one transition are met and then transition to the at least one other of said plurality of states; and said controller is further configured to use machine learning to determine said transitions.

7. The powered lower extremity orthotic of claim 6, further including:

said controller further configured to receive desired state transitions; and said controller further configured to use the machine learning to modify when a transition may be taken based on the intended motion of the person and said plurality of states so that said transitions will closely match said desired state transitions.

8. The powered lower extremity orthotic of claim 7, wherein said desired state transitions are configured to be selected by a second person who is medically trained.

9. The powered lower extremity orthotic of claim 7, wherein said desired state transitions are configured to be selected retrospectively.

10. A method of controlling a powered lower extremity orthotic including an exoskeleton having, a waist portion configurable to be coupled to an upper body of a person utilizing a gait aid, leg supports configurable to be coupled to lower limbs of the person and actuators for shifting of the leg supports relative to the waist portion to enable movement of the lower limbs of the person, the method comprising:

estimating an intended motion by directly observing motion of an upper arm, a lower arm or a palm of a hand of the person;

receiving the intended motion of the person from a human machine interface;

monitoring which of the leg supports of said powered lower extremity orthotic are in contact with the ground;

storing in a memory a current state of the powered lower extremity orthotic, with said state containing information including which of said leg supports are in contact with the ground, if the gait aid is in contact with the ground, and a sequence in which said leg supports and the gait aid contacted the ground;

determining if the intended motion appears to request one of a set of safe states, stored in the memory, to which the powered lower extremity orthotic can transition from the current state without causing the person to fall; and transitioning the powered lower extremity orthotic to said one of said safe states.

11. The method of claim 10, further comprising: determining where said safe states are through reachability analysis.

12. The method of claim 10, wherein said leg supports include sensors that are configured to measure a first distribution of weight on the ground when said leg supports contact the ground and are also configured to measure a second distribution of weight on the ground when said at least one gait aid contacts the ground, said method further comprising:

determining said set of safe states based on said first and second weight distributions.

13. The method of claim 10, further comprising estimating the intended motion with the human machine interface by observing motion of an upper arm, a lower arm or a palm of a hand of the person.

14. The method of claim 10, further comprising estimating the intended motion with the human machine interface by observing motion of the gait aid.

* * * * *